United States Patent [19]

Kelly

[11] Patent Number: 5,072,532

[45] Date of Patent: Dec. 17, 1991

[54] DECORATIVE PICTURE FRAME

[76] Inventor: Julia F. Kelly, 179 E. Lake Shore Dr., Chicago, Ill. 60611

[21] Appl. No.: 266,585

[22] Filed: Nov. 3, 1988

[51] Int. Cl.[5] ..... G09F 1/12

[52] U.S. Cl. ..... 40/152.1

[58] Field of Search ..... 40/152, 152.1, 546

[56] References Cited

U.S. PATENT DOCUMENTS

| | | | |
|---|---|---|---|
| 560,080 | 5/1896 | Booher | 40/152 |
| 1,202,589 | 10/1916 | Roosman | 40/152.1 |
| 1,844,278 | 2/1932 | Glaser | 40/152.1 |
| 2,548,126 | 4/1951 | Sholkin | 40/546 |
| 3,916,549 | 11/1975 | Storch et al. | 40/152.1 |

*Primary Examiner*—John G. Weiss
*Assistant Examiner*—Michael Lynch
*Attorney, Agent, or Firm*—Kinzer, Plyer, Dorn, McEachran & Jambor

[57] ABSTRACT

A decorative frame for a picture utilizing a flat piece of plate glass of generally uniform thickness having a front face and a rear face. A translucent band is etched on the front face of the piece of glass to define a picture viewing area. An ornamental design is etched on the rear face of the piece of glass outwardly of the translucent band. u-shaped plastic channels are adhered to the rear face of the piece of glass directly behind the translucent band so as not to be visible from the front face of the piece of glass. A picture backing board is snuggly received in the channels to hold the picture against the rear surface of the glass with the viewing area defined by the translucent band. A backing board support leg is attached to the rear of the backing board.

4 Claims, 1 Drawing Sheet

Fig.1.
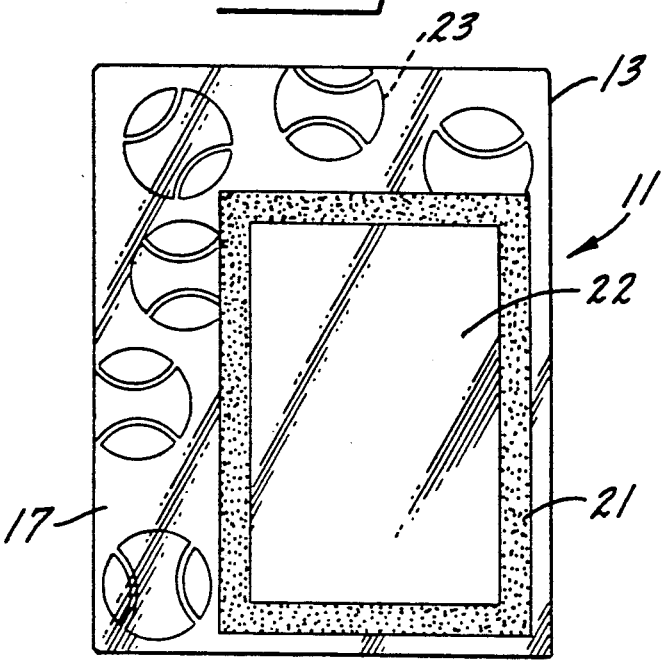
Fig.3.
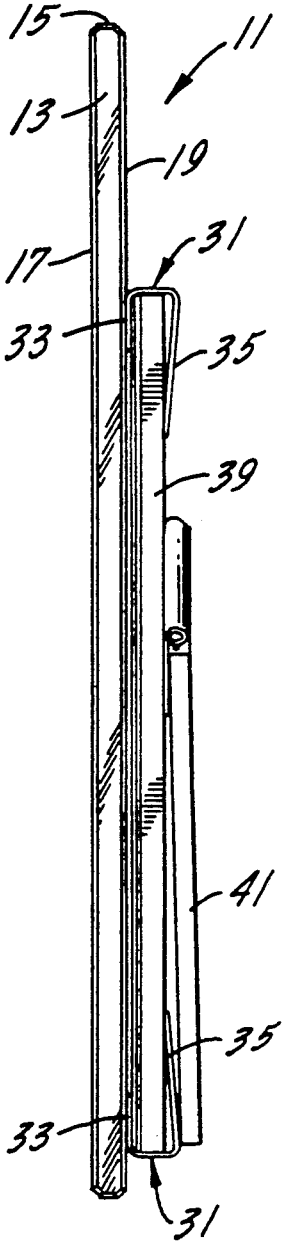
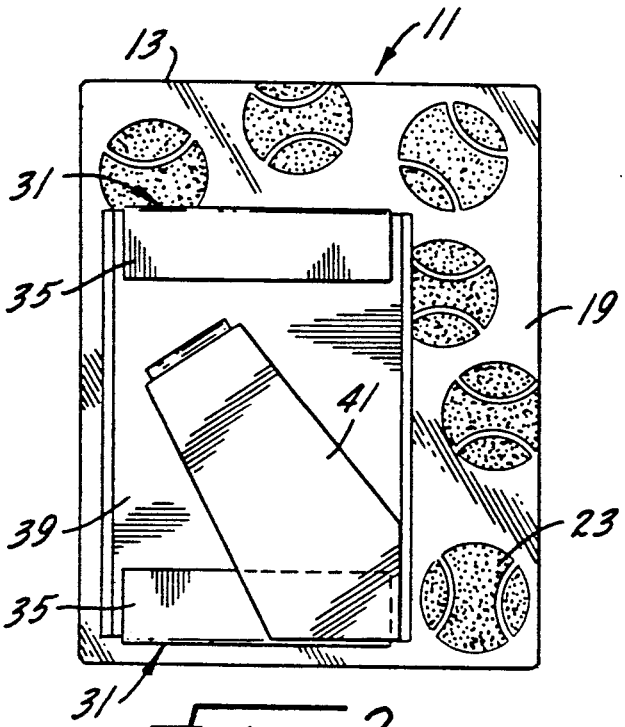
Fig.2.

DECORATIVE PICTURE FRAME

Background and Summary of the Invention

This invention is directed to a decorative frame for a picture which utilizes a flat piece of plate glass of generally uniform thickness to function as a protective overlay for a picture, a front structural member which replaces the conventional molding, a surface on which decorations can be formed, and an obscuring band for the viewing area of the picture.

An object of this invention is a simply constructed picture frame which utilizes a flat sheet of plate glass as a front structural member to replace the conventional molding and as a protective covering for a picture which is held against the rear surface of the glass.

Another object of this invention is a picture frame using a flat piece of plate glass as a front structural member and as a protective covering for the picture in which a picture viewing border is formed on the front surface of the piece of plate glass by etching the glass.

Another object of this invention is a picture frame utilizing a flat piece of glass as a front structural member and as a protective covering for the picture in which a border for the viewing area of the picture is formed on the front surface of the glass and decorations are formed on the rear surface of the glass outwardly of the border, in both instances, by etching the glass.

Another object of this invention is a picture frame utilizing a flat piece of glass as the front structural member of the frame and also as a protective covering for a picture in which the picture is held directly against the rear surface of the glass by a backing board which is captured between plastic channels adhered to the rear surface of the piece of glass.

Another object of this invention is a picture frame utilizing a flat piece of glass as the front structural member of the frame in which channels which hold the picture and its backing board in position are obscured from view from the front of the frame by a band etched on the front surface of the glass.

Another object of this invention is a picture frame utilizing a flat piece of plate glass as the front structural member of the frame and as the protective covering for a picture in which a band defining the picture viewing area is etched on the front of the piece of glass at a location offset from the center of the piece of glass to provide an area around the top and one side of the piece of glass and outwardly of the border to receive etched decorations.

Other objects of this invention may be found in the following specification, claims and drawings.

BRIEF DESCRIPTION OF THE DRAWINGS

The invention is illustrated more or less diagrammatically in the following drawings wherein:

FIG. 1 is a front view of a picture frame of this invention;

FIG. 2 is a back view of the picture frame of this invention; and

FIG. 3 is an enlarged, side elevational view of the picture frame of this invention.

DESCRIPTION OF THE PREFERRED EMBODIMENT

The drawings of this invention show a picture frame 11 formed of a flat piece of plate glass 13 of rectangular shape having beveled outer edges 15 to eliminate sharp edges and avoid injury to anyone who handles the frame. As is conventional, plate glass is of uniform thickness and is transparent with a front face 17 and a rear face 19.

In accordance with the novel aspects of this invention, the piece of plate glass 13 functions as the front structural member of the frame replacing the conventional molding and thin sheet of glass and also as a protective covering for a picture which will be held against the rear face 19 of the glass 13. To define a viewing area for the picture, which in this case is less than the total area of the piece of glass 13, a band 21 is etched onto the front face 17 of the piece of plate glass and is offset, being positioned in this example in the lower right-hand corner of the piece of glass, as viewed in FIG. 1. By etching I mean sandblasting, acid treatment, cutting, abrading or any other well-known method of treating the surface of a piece of glass. The etching of the surface of the glass provides a band 21 that is sufficiently translucent to conceal elements located behind it when viewed from the front of the picture frame. Thus, the band 21 will conceal the edges of the picture and any support members for the picture or frame which are aligned with the band on the back face 19 of the plate of glass. The translucent band encircles a viewing area 22 for a picture.

The band 21 is purposely made smaller in dimensions than the area of the plate glass 13 to allow a border around part or all of the frame to receive decorations. In this case the decorations 23, which resemble tennis balls, are etched on the rear face 19 of the piece of plate glass outwardly of the band 21. The use of representations of tennis balls is merely exemplary of the many types of designs that may be provided. Also, the location of the band 21 and its width and height can be varied to provide more or less area to receive decorations outwardly of the band.

To hold a picture and a picture backing board in place, U-shaped plastic channels 31 are adhered to the rear surface 19 of the plate glass 13. Each U-shaped plastic channel has a shorter leg 33 which is adhered to the rear face 19 of the glass and a longer leg 35 which is spaced rearwardly of the rear face of the glass. The shorter legs 33 of the plastic channels are aligned with the upper and lower portions of the band 21 so that they will be effectively concealed from view to a person looking at the frame from the front, as viewed in FIG. 1. A picture backing board 39 is dimensioned to be snuggly received within the plastic channels 31. If the picture frame 11 is to be of the self-standing type, a hinged leg 41 is affixed to the rear of the picture backing board. If the picture frame is to be hung, a hanger, not shown, can be attached to the longer leg 35 of the upper plastic channel 31.

The construction heretofore described permits the construction of a picture frame using a flat piece of plate glass 13 of uniform thickness which provides a viewing area for a picture, which area does not have to be cut out of or recessed in the back surface of the glass. By providing an etched band 21 on the front of the glass and decorative designs 23 on the rear surface of the glass, a unique floating appearance is provided for the designs. As can readily be appreciated, the designs 23 may be varied and can match the subject matter of the picture within the viewing area established by the band 21. In this example, tennis balls 23 are depicted and these would match with a picture of a tennis player. Other examples are readily apparent.

Whereas, I have shown and described a preferred embodiment of my invention, it should be understood and appreciated that it is not the only embodiment of my invention. For example, the shape of the piece of plate glass is not limited to rectangular since almost any shape may be used. The shape of the glass may be coordinated with the decorations. An example would be a heart-shaped piece of glass with Valentine decorations. Although I prefer that the decorations be etched on the rear face of the piece of plate, decorations and designs may be etched or surface mounted on the front face of the piece of glass. The band surrounding the picture need not be rectangular in shape and it need not be offset to one side and bottom of the piece of glass. It can be varied to match the shape of the piece of glass. Therefore, the scope of my invention should be limited only by a liberal interpretation of the claims appended hereto.

I claim:

1. A decorative frame for a picture, including:

a flat piece of plate glass of generally uniform thickness having a front face and a rear face, a translucent band etched on the front face of the glass to define a picture viewing area, an ornamental design etched on the rear face of the glass outwardly of the translucent band, and support means adhered to the rear face of the glass behind the translucent band so as not to be visible from the front face of the piece of glass, said support means adapted to receive a picture backing board and a backing board support leg to hold the picture against the rear face of the glass and within the viewing area defined by the translucent band.

2. The decorative frame of claim 1 in which said flat piece of plate glass is rectangular in shape and said translucent band is rectangular in shape.

3. The decorative frame of claim 2 in which said translucent band is offset to the bottom and one side of the rectangular piece of glass.

4. A decorative frame for a picture including:

a flat piece of plate glass of generally uniform thickness having a front face and a rear face, a translucent band etched on the front face of the glass to define a photograph viewing area, an ornamental design etched on the rear face of the plate of glass outwardly of the translucent band, and support means adhered to the rear face of the glass behind the translucent band so as not to be visible from the front face of the piece of glass, said support means adapted to support the picture and picture backing board to hold the picture against the rear face of the glass and within the viewing area defined by the translucent band.

* * * * *